United States Patent [19]

Kapler et al.

[11] Patent Number: 4,708,658

[45] Date of Patent: Nov. 24, 1987

[54] APPARATUS FOR ELIMINATING NOISE IN CONDUCTIVE-BEARING ELECTRICAL CONNECTORS

[76] Inventors: Albert W. Kapler, 6 Travers Ave., Edison, N.J. 08817; Joseph A. Kapler, 197 R Fresh Ponds Rd., South Brunswick, N.J. 08831

[21] Appl. No.: 898,354

[22] Filed: Aug. 20, 1986

[51] Int. Cl.[4] ..... H01R 39/00

[52] U.S. Cl. ..... 439/21; 439/25; 439/28; 439/862

[58] Field of Search ..... 339/1-8, 339/182, 183, 256 S, 255, 41, 177 R, 177 E, 258 R, 258 P

[56] References Cited

U.S. PATENT DOCUMENTS

| | | | |
|---|---|---|---|
| 2,766,625 | 10/1956 | Swanson | 339/5 M |
| 3,234,495 | 2/1966 | Martinez | 339/5 M |
| 3,259,727 | 7/1966 | Casler | 339/2 RL |
| 3,416,121 | 12/1968 | Nealon et al. | 339/8 PB |
| 3,998,511 | 12/1976 | Jensen | 339/5 M |
| 4,223,911 | 9/1980 | Cymbal et al. | 339/5 M |

*Primary Examiner*—Gil Weidenfeld

*Assistant Examiner*—David Pirlot

*Attorney, Agent, or Firm*—Arthur L. Plevy

[57] ABSTRACT

There is disclosed a conductive ball bearing assembly having an outer and inner race and operative to rotate with respect to one another about a common axis to allow an input wire electrically conducted to the outer race to rotate with respect to an output wire electrically conducted to the inner race. The improvement therewith consists of apparatus which eliminates electrical noise due to rotation which apparatus includes an electrically conductive C-shaped member or ring adapted to be clamped over said outer race and including depending spring assembies secured to said ring for resiliently contacting the inner race during rotation of said assembly. The spring assembly may consist of coiled springs or an arcuate spring member which are conductive and which depend from the C-shaped member to contact the periphery of the inner race at right and left sides to therefore shunt the electrical contact made by the conductive bearings between the inner and outer race and to therefore eliminate noise associated with such conductive bearing assemblies.

17 Claims, 9 Drawing Figures

APPARATUS FOR ELIMINATING NOISE IN CONDUCTIVE-BEARING ELECTRICAL CONNECTORS

BACKGROUND OF THE INVENTION

This invention relates to apparatus for preventing the twisting of electrical cords or cables in general, and more particularly to apparatus which is employed in conjunction with a bearing assembly utilized for preventing the twisting or coiling of a wire or a cord and employed for eliminating noise in the conductive bearing assembly during operation.

The prior art is replete with a number of patents which relate to the problem of avoiding the twisting or coiling of various wires. Many of such patents utilize a conductive bearing assembly to allow rotation of one wire with respect to another, while other patents utilize such a conductive-bearing assembly to prevent the twisting of an input wire with respect to an output wire.

Essentially, reference is made to U.S. Pat. No. 4,592,605 entitled APPARATUS FOR PREVENTING THE TWISTING OF AN ELECTRICAL CORD OR CABLE, which patent issued on June 3, 1986 to Albert W. Kapler of Edison, N.J., one of the inventors herein.

As one can ascertain from that patent, there is disclosed an apparatus for preventing the undesirable twisting of an input wire or cable. Essentially, the apparatus includes a housing which has an input and output port and an internal hollow. Located within the hollow is a ball bearing assembly having an inner and outer race electrically connected to the other by means of the roller bearings. An input wire is conducted to the outer race which for example is rigidly secured to the housing, while the inner race has a central aperture into which aperture is positioned a partial circular conductive plate. An input wire is electrically connected to the outer race, while the output wire is electrically conducted to the plate associated with the inner race. Thus the bearing assembly provides a connection between the wire connected to the outer race and the wire connected to the inner race via conductive ball bearings.

Essentially, the conductive plate is associated with an elongated rod or other device which is coupled to adjacent bearing assemblies via their associated plates. The entire apparatus as described in this patent is particularly adapted to prevent the twisting of an electrical cable such as a telephone cord or similar cord. In this manner the coiling or twisting of a cord is prevented by utilizing the apparatus depicted in that patent.

As indicated above and as one can ascertain from the art cited against the patent, conductive-bearing assemblies have been employed in many applications to prevent the twisting of wires or to allow an input wire to rotate with respect to an output wire such as for making connections to various motor devices, commutators and so on.

It is therefore believed that the type of prior art cited in the above-noted patent and also the type of prior art cited against the above-noted patent application during prosecution generally relates to such concepts as will be described herein.

Before proceeding with an explanation of the invention, it is indicated that such conductive-bearing assemblies are relatively expensive. In any event, most bearing assemblies are completely conductive due to the fact that the roller bearings are fabricated from a conductive metal as is the inner and outer race. As one can ascertain, when utilized in a telephone system, such a conductive bearing assembly produces a whistling sound or noise as electrical contact is not firmly made between the bearings and the inner and outer races during rotation. Thus during the twisting of the cord, the rotation of the bearings will tend to interrupt communications or electrical contact or provide electrical noise.

In any event as the bearings rotate with respect to the inner and outer races, a whistling sound or various other sounds may be produced on the telephone line. As one can also ascertain, it would be a desire to provide such apparatus as inexpensively as possible to enable the apparatus to be mass produced at an extremely economical cost.

Hence it is a main object of this invention to provide a device utilizinga bearing assembly which device is employed for preventing the twisting or coiling of a telephone wire or other wire and for providing an optimum electrical contact between the same.

As is indicated, it is an object of this invention to provide a roller bearing assembly which will enable one to couple an input wire to an output wire and to prevent twisting or coiling of the same or to enable the rotation of the output wire with respect to the input wire while providing a reliable and effective electrical connection.

As one will ascertain, certain of the prior art devices utilized a connection between the inner and outer races which usually consisted of a metallic member which essentially was electrically connected from the outer race to the inner race to prevent the above-noted problem of electrical noise. In any event, such devices as described in the prior art were not reliable in that the wire employed would become brittle or would essentially lose contact with the inner and outer races thus creating additional problems.

It is therefore a further object of the present invention to provide electrical contact between a conductor bearing assembly while preventing undue noise during rotation of the same.

BRIEF DESCRIPTION OF THE PREFERRED EMBODIMENT

In a ball bearing assembly having an outer and an inner race and operative to rotate with respect to one another about a common axis, to allow an input wire electrically coupled to the outer race to rotate with respect to an output wire electrically coupled to the inner race; the improvement in combination therewith of apparatus for eliminating electrical noise due to said rotation, comprising an electrically conductive C-shaped member adapted to be clamped over said outer race and including a spring assembly secured to said ring for resiliently contacting said inner race during rotation of said assembly to provide a low noise electrical path between said inner and outer races during said rotation.

DETAILED DESCRIPTION OF THE FIGURES

Figure 1:
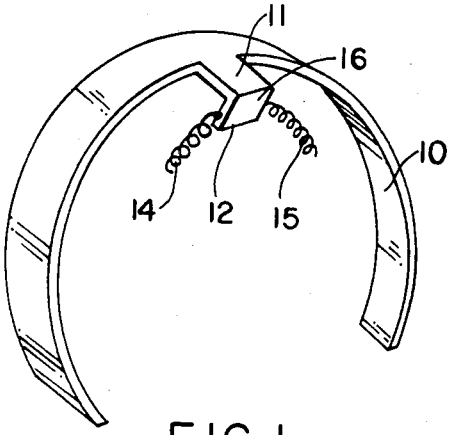
FIG. 1 is a perspective plan view of an apparatus for eliminating noise in a conductive bearing assembly according to this invention.

Referring to FIG. 1, there is shown a C-shaped clamp 10. The C-shaped clamp is approximately ¾ of a circle or ½ of a circle.

The C-shaped clamp is made of a good conductive material such as stainless steel, copper or some other material. Located relatively central to the C-shaped clamp 10 is the projecting flange 11 which flange 11 is integrally formed with a depending flange 16. Secured to the depending flange is a conductive coiled spring device designated by numerals 14 and 15. As seen from FIG. 1, the spring forms right and left spring arms 14 and 15. The spring arms can be two separate springs or a single spring which is soldered or otherwise welded or secured to make an electrical connection to the depending flange 16 associated with the C-shaped clamp 10.

Both coiled spring members as 14 and 15 are fabricated from conductive material and fabricated from a good conductor such as copper, stainless steel and so on.

Figure 2:
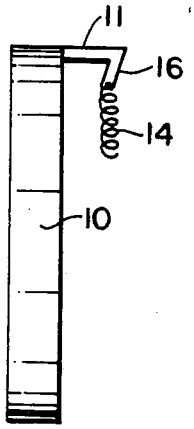
FIG. 2 is a side view of the apparatus depicted in FIG. 1.

Referring to FIG. 2, there is shown a side view of the C-shaped clamp 10 with the extending flange 11 and the depending flange 16 as secured and electrically coupled to a conductive spring arm 14. The depending flange 16 may be at a slight angle directed towards the main bearing body.

Figure 3:
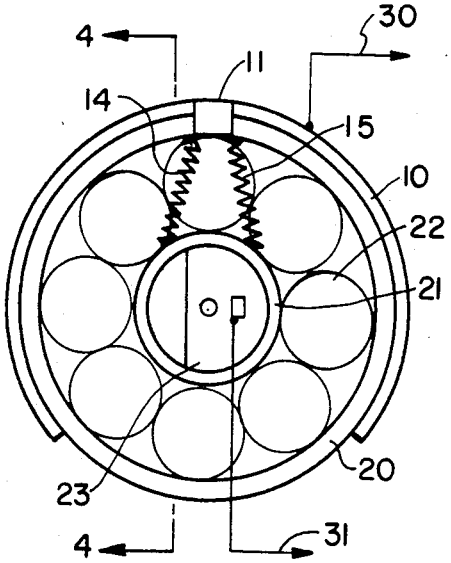
FIG. 3 is a front plan view showing the apparatus of FIG. 1 operating in conjunction with a ball bearing assembly.

Referring to FIG. 3, there is shown a front view of a conductive bearing assembly which is utilized for coupling an input wire such as wire 30 to an output wire such as wire 31. The conductive bearing assembly essentially operates to that wire 30 is normally connected to the outer race 20 of the bearing assembly by means of soldering or welding or some other connection. The output wire 31 is connected to the inner race or the annular structure associated with the inner race 21 also by means of an electrical bonding technique such as soldering welding and so on.

Shown in FIG. 3 is the type of apparatus depicted in the above-noted U.S. Pat. No. 4,592,605. As indicated in that patent, there is an inner plate of semicircular configuration 23 which is electrically connected by the inner race within the aperture of the inner race 21. The output wire 31 is then secured or soldered into an aperture associated with the inner plate. In any event, it can be seen that a bearing assembly as shown in FIG. 3 makes an electrical connection between the outer conductive race 20 via the associated ball bearings 22 to the inner conductive race 21. Hence if the outer race 20 were secured against rotation or rigidly fixed, the inner race 21 would rotate with respect thereto due to the action of the ball bearings and as is well known in the art.

In this manner the wire 30, while fixed to the outer race, would be stationary, and wire 31 fixed to the inner race via the plate or otherwise would rotate with respect thereto. The electrical connection between the wires being made between the conductive ball bearing assembly such as assembly 21 located between the inner and outer race. This aspect of the invention has been described in the above-noted referenced U.S. patent and also in many prior art devices.

As one can ascertain, during rotation or operation, especially when utilizing the bearing assembly for use in a telephone subset, one will experience a whistling sound or other electrical noise. This noise is due to the fact that the electrical connection is not continuous and may be intermittent due to the operation and tolerances of the ball bearings with respect to the inner and outer races.

As one can understand, if one obtained fairly accurate ball bearing assemblies then the conduction would become increasingly better based on holding mechanical tolerances within predetermined values. In any event, in order to utilize an inexpensive ball bearing assembly and to obtain all the advantages of operation, the above-noted C-shaped ring with the depending spring mechanism operates to assure good electrical contact at a relatively minimum cost.

As seen from FIG. 3, the C-shaped ring 10 is clamped on or clipped on to the periphery of the outer race 21 wherein good electrical contact is made due to the large surface area of the C-shaped ring. The input wire 30 may be coupled to the C-shaped ring as shown in FIG. 3 or may be coupled to the outer race 21 as described in the above-noted patent.

The projecting flange 11 with the associated depending flange 16 causes the spring arms 14 and 15 to contact the outer periphery of the inner race 21. If a larger diameter spring is selected, the spring will ride in the channel between the races thus contacting both races. As one can see, as rotation occurs, the spring always remains in contact with the race and due to the flexible nature of the conductive coiled spring arrangement contact is made thus completely eliminating the necessity of providing contact via the ball bearings 22. Since both spring members as 14 and 15 are conductive, contact will be maintained during all rotational operation between the inner and outer race.

Figure 4:
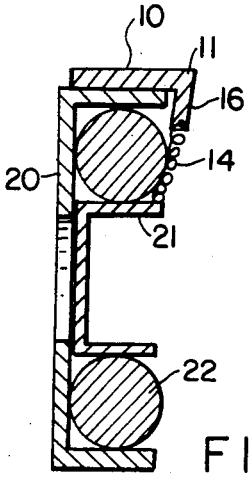
FIG. 4 is a cross sectional view taking through line 4—4 of FIG. 3.

As shown in FIG. 4, there is a cross sectional view of the apparatus depicted in FIG. 3. In FIG. 4, one can readily ascertain that the spring member 14 is in contact with the outer periphery of the inner race 21, thus assuring excellent electrical connection between the outer and inner race during rotation of the bearing assembly. This apparatus, by using a coiled spring, therefore eliminates the whistling or noise problem associated with prior art conductive bearing assemblies.

Furthermore, the spring assemblies, due to the nature of the coiled spring and the conductivity of the same, prevent most of the problems associated with the prior art. As one can ascertain, the spring assemblies are placed so that they contact the outer periphery of inner race which normally extends beyond the bearing assembly as shown in FIG. 4. In this manner multiple coils of the springs 14 and 15 impinge upon or coact with the outer peripheral surface of the inner race 21, thus providing excellent electrical contact during all operating positions. The entire C-shaped clamp assembly as shown in FIG. 1 is extremely easy to implement and is an extremely inexpensive component consisting of a conventional C-shaped clamp 10 with the associated flange sections 11 and 16 having secured thereto by means of a solder joint or weld conductive spring assemblies 14 and 15.

As one can immediately ascertain, ball and roller bearing assemblies are well known and the consist of two annular components known as races and as indicated above, namely, an inner and outer race. The rolling elements or the balls are retained in a cage between the races.

In regard to this invention, many different types of well known ball bearing assemblies can be employed, such as needle roller bearings, cylindrical roller bearings and many other typical conventional devices. As one can also ascertain, most of the ball bearing assemblies manufactured are, in fact, electrically conductive between the inner and outer races. In any event, the degree of conductivity regarding the degree of contact made is not particularly held to any close tolerances by the manufacturer unless the bearing assembly is made especially to be electrically conductive.

In any event, as indicated above such bearing assemblies while providing good conductivity are relatively expensive compared to conventional bearing assemblies.

Hence this invention utilizes the C-shaped clamp 10 which is snapped on to or otherwise secured to the outer race and which accommodates the spring members as 14 and 15 to allow the members to be in intimate contact with the inner race or between the periphery of the inner and outer races. Thus the C-shaped clamp acts as a main connection between the inner and outer races while the ball bearings, of course, allow rotation of the entire assembly to prevent the twisting or to allow one to utilize the apparatus as desired.

Hence the conductive ball bearing assembly as indicated above which includes a C-shaped clamp will find wide spread use in such devices as for example devices employed to prevent twisting and coiling of an output cable with respect to an input cable. The assembly can be utilized in such embodiments whether or not incorporating the mechanism as depicted in U.S. Pat. No. 4,592,605 or in any other apparatus employing bearing assemblies for allowing an input cable to rotate or to prevent twisting of an input cable with respect to an output cable.

Figure 5:
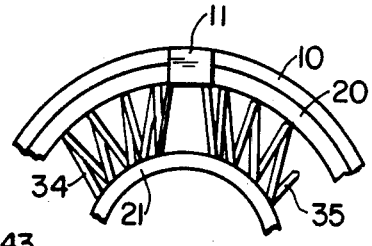
FIG. 5 is a partial front plan view showing an alternate embodiment of this invention.

Referring to FIG. 5, there is shown an alternate embodiment which essentially consists of the C-shaped clamp 10 which again is snapped over the outer race 20, as for example in the manner shown in FIG. 3. The depending flange 11 has secured thereto a single spring which comprises a left- and a right-hand section as 34 and 35. In any event, as can be seen from FIG. 5, this spring is larger in diameter than springs depicted for example in FIGS. 1 and 3.

The spring essentially rides or sits in the channel or space between the flanges or the inner and outer races and hence provides contact between the inner and outer races as above indicated while further resting in the channel formed between the inner and outer races. In this manner a plurality of separate coils of the spring members as 34 and 35 provide contact with the inner and outer races thus providing even more reliable contact than the embodiment shown above.

Figure 6:
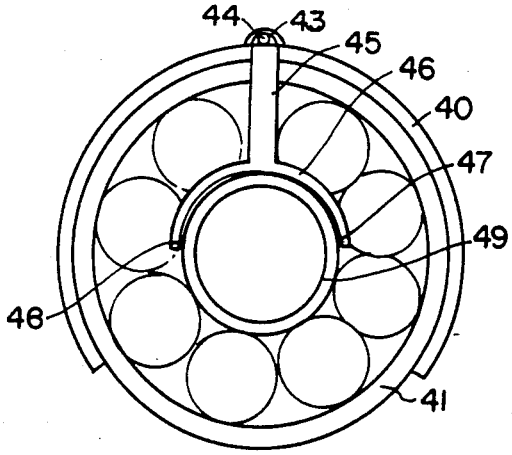
FIG. 6 is a front plan view showing still another embodiment of the invention employing an arcuate spring-like member.
Figure 7:
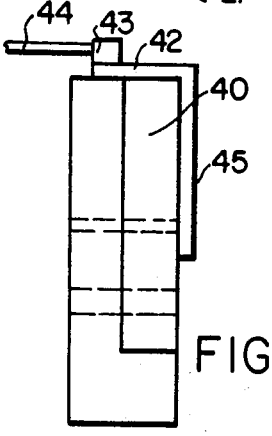
FIG. 7 is a side view of the embodiment of FIG. 6.

Referring to FIGS. 6 and 7, there is shown an alternate embodiment of the above-described mechanism. As seen in FIG. 6, there is a C-shaped ring 40. The C-shaped ring again clamps to or is secured about the outer race of the ball bearing assembly 41. The C-shaped ring as seen in FIG. 7 has a depending flange 42 which has a central area 43 adapted to receive an input wire 44 and to act as a crimping mechanism for the wire. The depending flange 42 has coupled thereto an elongated member 45 which member is conductive. The member 45 is secured to an arcuate member 46 which essentially is semicircular and forms right and left extending spring-like arms.

Figure 8:
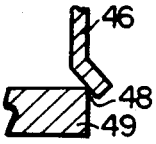
FIG. 8 is a partial sectional view showing the contact afforded by the device of FIG. 6.
Figure 9:
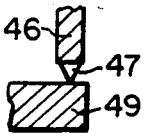
FIG. 9 is a partial sectional view showing another form of contact provided by the apparatus depicted in FIG. 6.

Essentially, the arcuate member 46 has a diameter slightly greater than the diameter of the inner race and is located above the inner race 49. The member has two contacts on a left and right side as contacts 47 and 48 which contacts touch the top surface of the inner race to make electrical contact therewith. The entire assembly may be fabricated of tampered spring steel, brass or copper, or some other good conductive material. Hence as one can ascertain, as the inner race 49 rotates with respect to the outer race, the contacts 47 and 48 contact the outer peripheral surface of the inner race 49 as for example shown in FIGS. 8 and 9. In this manner one is assured of good contact. The arms which emanate from the arcuate section 46, as the right and left arms, are essentially spring-like members but contact is mainly relied on by the contacting surfaces as 47 and 48 which are further depicted in FIGS. 8 and 9 in two different embodiments. In this manner one can fabricate the assembly as shown in FIGS. 6 and 7 and afford the same type of operation as for example the spring assembly depicted in FIGS. 1–5.

What is claimed is:

1. In a ball bearing assembly having an outer and an inner race and operative to rotate with respect to one another about a common axis, to allow an input wire electrically coupled to the outer race to rotate with respect to an output wire electrically coupled to the inner race, the improvement in combination therewith of an apparatus for eliminating electrical noise due to said rotation, comprising:

an electrically conductive C-shaped member adapted to be clamped over said outer race and including a spring assembly secured to said member for resiliently contacting said inner race during rotation of said assembly to provide a low noise electrical path between said inner and outer races during said rotation, said C-shaped member including a projecting extending flange extending from the periphery thereof and integral with a depending flange extending towards said inner race with said depending flange electrically connected to right and left depending conductive spring assemblies for contacting the surface of said inner race to maintain an electrical connection between said outer and inner races during rotation of said bearing assembly.

2. The ball bearing assembly combination according to claim 1, wherein said C-shaped member is a partial circular ring of a conductive material of a given diameter to allow the same to be clamped over said outer race to provide electrical contact therewith.

3. The ball bearing assembly combination according to claim 1, wherein said input wire is electrically connected to said C-shaped member with said output wire electrically connected to said inner race.

4. The ball bearing assembly combination according to claim 1, wherein said depending flange is at a downwardly sloping angle as depending from said projecting flange and directed towards said inner race.

5. The ball bearing assembly combination according to claim 1, wherein said right and left depending spring assemblies are coiled spring assemblies.

6. The ball bearing assembly combination according to claim 5, wherein a plurality of coils of each assembly coact with the periphery of said inner race.

7. In a ball bearing assembly having an outer and inner race and operative to rotate with respect to one another abut a common axis, to allow an input wire electrically coupled to said outer race to rotate with respect to an output wire electrically coupled to said inner race, the improvement in combination therewith of an apparatus for eliminating electrical noise due to said rotation, comprising:

conductive spring means coupled to said outer race and directed inwardly to extend to and contact the periphery of said inner race at a right and a left side to provide a low noise electrical path between said inner and outer races during rotation, said conductive spring means including a C-shaped conductive clamp means adapted to be emplaced over said outer race and having a projecting flange electrically coupled to right and left coiled spring members which members extend inwardly from said outer race wherein each contact the periphery of said inner race.

8. The ball bearing assembly combination according to claim 7, wherein said projecting flange is integrally associated with a depending flange portion for coupling said spring members thereto.

9. The ball bearing assembly combination according to claim 7, wherein said right and left coiled spring members are formed from a single conductive coiled spring coupled to said said C-shaped clamp near the center of said single spring.

10. The ball bearing assembly combination according to claim 7, wherein said C-shaped conductive clamp is fabricated from spring steel.

11. The ball bearing assembly combination according to claim 7, wherein said C-shaped conductive clamp is of a slightly greater diameter than said outer race and is placed over the same.

12. The ball bearing assembly combination according to claim 7, wherein said coiled spring members are soldered to said clamp.

13. The ball bearing assembly combination according to claim 7, wherein said coiled spring members are welded to said clamp.

14. The ball bearing assembly combination according to claim 7, wherein said ball bearing assembly has conductive roller bearings.

15. The ball bearing assembly combination according to claim 1, wherein said ball bearing assembly has conductive roller bearings.

16. In a ball bearing assembly having an outer and an inner race and operative to rotate with respect to one another about a common axis, to allow an input wire electrically coupled to the outer race to rotate with respect to an output wire electrically coupled to the inner race, the improvement in combination therewith of an apparatus for eliminating electrical noise due to said rotation, comprising:

an electrically conductive C-shaped member adapted to be clamped over said outer race and including a spring assembly secured to said member for resiliently contacting said inner race during rotation of said assembly to provide a low noise electrical path between said inner and outer races during said rotation, said spring assembly taking the form of a single coiled conductive spring electrically connected near its center to said member and having a right and a left section extending towards said inner race to electrically contact said inner race.

17. In a ball bearing assembly having an outer and inner race and operative to rotate with respect to one another about a common axis, to allow an input wire electrically coupled to said outer race to rotate with respect to an output wire electrically coupled to said inner race, the improvement in combination therewith of an apparatus for eliminating electrical noise due to said rotation, comprising:

conductive spring means coupled to said outer race and directed inwardly to extend to and contact the periphery of said inner race at a right and a left side to provide a low noise electrical path between said inner and outer races during rotation, said conductive spring means including a C-shaped conductive clamp means adapted to be emplaced over said outer race and having a projecting flange electrically coupled to an arcuate member having left and right contacts to contact said inner race at a left and right side.

* * * * *